US008398056B1

(12) United States Patent
Morrison

(10) Patent No.: US 8,398,056 B1
(45) Date of Patent: Mar. 19, 2013

(54) MOTORCYCLE LIFT AND SUPPORT APPARTUS

(76) Inventor: William G. Morrison, Moreno Valley, CA (US)

( * ) Notice: Subject to any disclaimer, the term of this patent is extended or adjusted under 35 U.S.C. 154(b) by 389 days.

(21) Appl. No.: 12/800,397

(22) Filed: May 14, 2010

(51) Int. Cl.
*B66F 3/24* (2006.01)

(52) U.S. Cl. .... 254/93 H; 254/134; 254/98; 254/133 R; 248/352

(58) Field of Classification Search ..... 254/131, 254/133 R, 134, 98, 10 B, 85, 100, 8 R, 8 B, 254/93 H, 93 R, 89 H, 88, 119–120, 102–104, 254/7 B, 7 R, 2 B, 20; 211/17, 21, 22, 24; 248/152, 352
See application file for complete search history.

(56) References Cited

U.S. PATENT DOCUMENTS

| | | | | |
|---|---|---|---|---|
| 4,662,617 | A | 5/1987 | Ditterline, Jr. et al. | |
| 4,690,361 | A * | 9/1987 | Lundman | 248/352 |
| 5,118,126 | A | 6/1992 | Yaple | |
| 5,358,265 | A | 10/1994 | Yaple | |
| 5,518,224 | A | 5/1996 | Anderson | |
| 5,520,360 | A * | 5/1996 | Wensman | 248/354.5 |
| 5,639,067 | A | 6/1997 | Johnson | |
| 5,901,935 | A * | 5/1999 | Lai | 248/354.1 |
| 5,915,672 | A * | 6/1999 | Dickey | 254/133 R |
| 6,019,337 | A * | 2/2000 | Brown | 248/354.5 |
| 6,092,787 | A | 7/2000 | Nayman | |
| 6,193,078 | B1 | 2/2001 | Stuhlmacher | |
| 6,443,413 | B1 * | 9/2002 | Hawkins et al. | 248/352 |
| 6,598,855 | B1 | 7/2003 | Petrone et al. | |
| 6,644,615 | B1 * | 11/2003 | Liu | 248/352 |
| 7,147,211 | B2 * | 12/2006 | Porter | 254/93 H |
| 7,320,460 | B1 | 1/2008 | Hastrich | |
| 8,201,807 | B2 * | 6/2012 | Hernandez, Jr. | 254/93 H |
| 2004/0007697 | A1 | 1/2004 | Petrone et al. | |
| 2008/0203265 | A1 * | 8/2008 | Zhang | 248/352 |

* cited by examiner

*Primary Examiner* — Basil Katcheves
*Assistant Examiner* — Beth Stephan
(74) *Attorney, Agent, or Firm* — P. Jeff Martin; The Law Firm of P. Jeffrey Martin, LLC

(57) ABSTRACT

A motorcycle lift and support apparatus is disclosed for lifting and supporting a motorcycle for various purposes such as repair, maintenance, and storage. The apparatus of the present invention includes a retractable wheel system to facilitate apparatus mobility.

20 Claims, 6 Drawing Sheets

MOTORCYCLE LIFT AND SUPPORT APPARTUS

RELATED APPLICATIONS

There are no previously filed, nor currently any co-pending applications, anywhere in the world.

BACKGROUND OF THE INVENTION

1. Field of the Invention

This application discloses and claims embodiments generally related to motorcycle lift apparatuses, and more particularly, to a portable motorcycle lift and support apparatus.

2. Description of the Related Art

The prior art discloses various motorcycle lifts and stands. However, these lifts and stands fail to teach or disclose a motorcycle lift and support apparatus adapted to raise and lower a motorcycle, and which allows for the motorcycle to be mobilized or immobilized while in a raised and supported state as selectively desired by user.

Accordingly, a long felt need has been realized for a portable motorcycle lift and support apparatus adapted with retractable wheels to allow such apparatus to be mobilized according to user preference. The development of the portable motorcycle lift and support apparatus fulfills this need.

A search of the prior art did not disclose any patents that read directly on the claims of the instant invention; however, the following references were considered related.

U.S. Pat. No. 6,598,855 B1, issued in the name of Petrone et al.;
U.S. Pat. No. 7,320,460 B1, issued in the name of Hastrich;
U.S. Pat. No. 5,518,224, issued in the name of Anderson;
U.S. Pat. No. 5,358,265, issued in the name of Yaple;
U.S. Pat. No. 6,193,078 B1, issued in the name of Stuhlmacher,
U.S. Pat. No. 6,092,787, issued in the name of Nayman;
U.S. Patent Application no. 2004/0007697, published in the name of Petrone et al.;
U.S. Pat. No. 5,118,126, issued in the name of Yaple;
U.S. Pat. No. 5,639,067, issued in the name of Johnson; and
U.S. Pat. No. 4,662,617, issued in the name of Ditterline, Jr. et al.

Consequently, a need has been felt for a portable motorcycle lift and support apparatus adapted with retractable wheels to allow such apparatus to be mobilized as selectively desired by user. This application presents claims and embodiments that fulfill a need or needs not yet satisfied by the products, inventions and methods previously or presently available. In particular, the claims and embodiments disclosed herein describe a motorcycle lift and support apparatus designed and configured for lifting and supporting a motorcycle for various purposes such as repair, maintenance, and storage. The apparatus of the present invention comprises a base frame, the base frame comprising: a vertically extending, tubular center post from which a plurality of tubular base legs extends downward angularly therefrom; a lift platform; a linearly elongated, tubular center member welded centrally to the lower surface of the lift platform so as to extend downward vertically therefrom, the center member is telescopically received by the center post; a platform linear actuator for raising the lift platform between a lowered position and a fully raised position; a caster carriage assembly; and a carriage linear actuator for raising the caster carriage assembly between a lowered position and a fully raised position, wherein the apparatus of the present invention providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

In accordance with one embodiment of the present invention, a motorcycle lift and support apparatus is disclosed for lifting and supporting a motorcycle. The motorcycle lift and support apparatus comprises a base frame, comprising a vertically extending, tubular center post from which a plurality of tubular base legs extends downward angularly therefrom.

A lift platform is provided having a center member mounted to a lower surface thereof. The center member is adapted to be telescopically received by the center post of the base frame.

The apparatus of the present invention further comprises a platform linear actuator for manually raising the lift platform between a lowered position and a fully raised position. The platform linear actuator comprises a linkage comprised of a rigid, upper long link member and a rigid, lower short link member. A compression damper is provided for lowering the lift platform in a controlled manner. The compression damper is housed within the center member.

A caster carriage assembly is disclosed, wherein the caster carriage assembly comprises a first framework and a second framework. The first framework is permanently connected to the second framework by a plurality of vertical rails so as to form a box structure with open sides. The box structure is positioned around and snugly engages the center post in a manner such that the plurality of tubular base legs of the base frame protrude through respective open sides of the box structure.

The caster carriage assembly further comprises a plurality of caster linkage assemblies, wherein each caster linkage assembly comprises a rigid, short link member pivotally coupled to a rigid, long link member. The plurality of caster linkage assemblies are each arranged so as to be partially housed within a respective inner chamber of each respective tubular base leg. The lower end of each long link member of the caster linkage assemblies includes a caster assembly support plate mounted to a lower surface thereof. Each of the caster assembly support plates has a caster assembly secured to and extending downwardly from a bottom surface thereof. The caster assemblies allow for rolling mobility of the apparatus of the present invention.

A carriage linear actuator is provided for manually raising the caster carriage assembly between a lowered position and a fully raised position. Raising the caster carriage assembly actuates simultaneous lowering of all the caster assemblies, and lowering the caster carriage assembly actuates simultaneous raising of all the caster assemblies. The actuator comprises a linkage comprised of a rigid, upper long link member pivotally coupled to a rigid, lower short link member.

The use of the present invention allows a motorcycle to be supported in a raised position and mobilized while in such raised position according to user preference in a quick, easy, and efficient manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
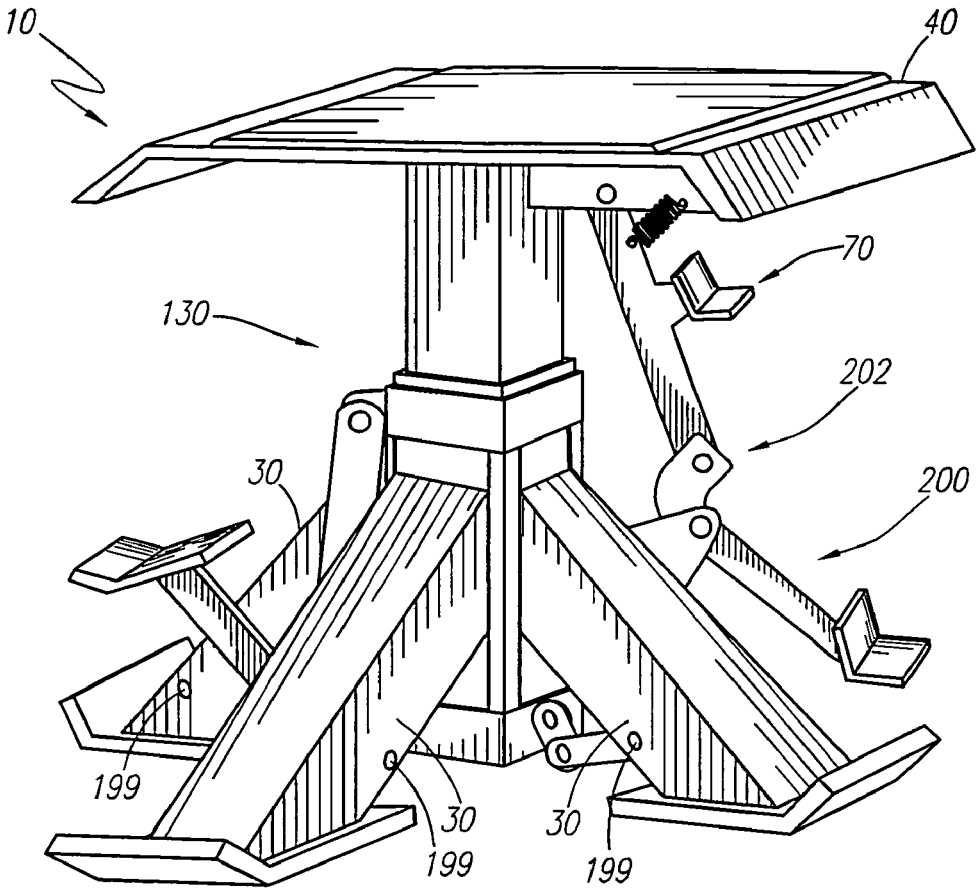
FIG. 1 is a perspective view of a motorcycle lift and support apparatus shown in a fully raised position, according to the preferred embodiment of the present invention.
Figure 2:
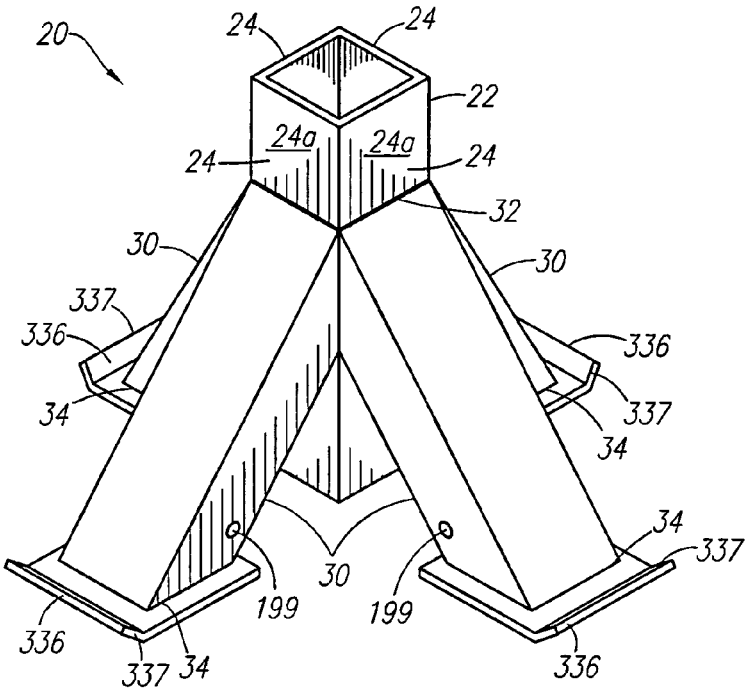
FIG. 2 is a perspective view of the base frame, according to the preferred embodiment of the present invention.
Figure 3A:
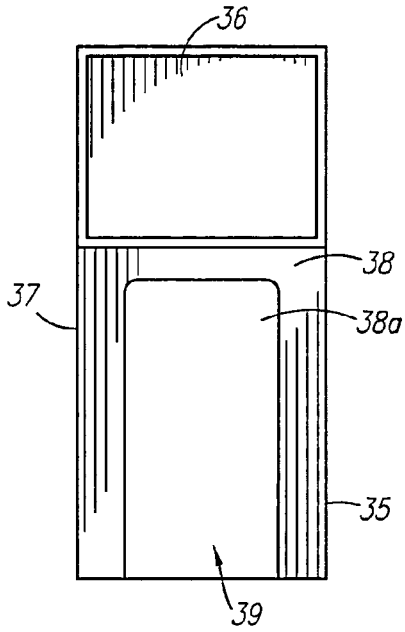
FIG. 3A is a front elevational view of one of the tubular base legs, according to the preferred embodiment of the present invention.
Figure 3:
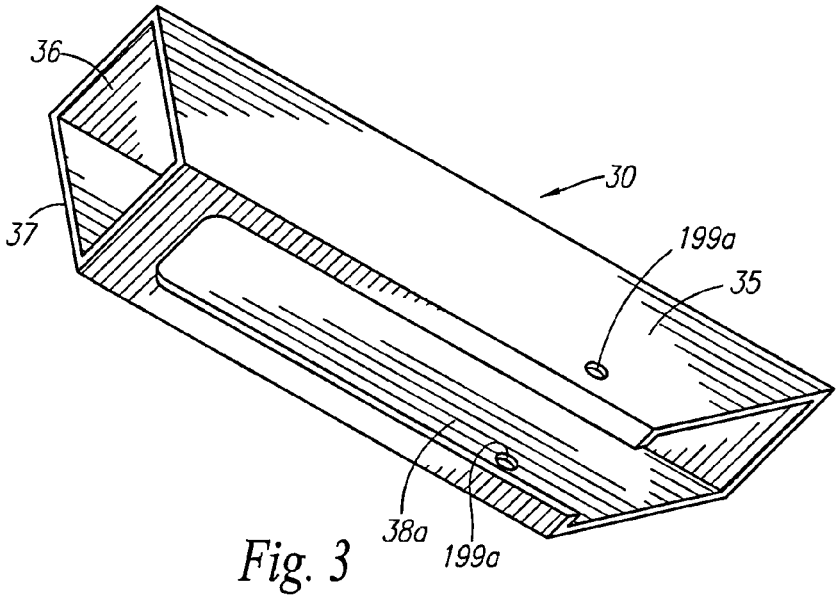
FIG. 3 is a perspective fragmentary view of one of the tubular base legs, according to the preferred embodiment of the present invention.

With reference to FIGS. 1-3, a motorcycle lift and support apparatus 10 is disclosed, according to one embodiment of the present invention. The motorcycle lift and support apparatus 10 is designed for lifting and supporting a motorcycle M for various purposes such as repair, maintenance, and storage. The motorcycle lift and support apparatus 10, hereinafter referred to as "apparatus 10" comprises a base frame 20 comprising a vertically extending, tubular center post 22 from which a plurality of tubular base legs 30 extends downward angularly therefrom. The tubular base legs 30 each define an upper end 32 opposing a lower end 34, and four sidewalls 35, 36, 37, 38. The four sidewalls 35, 36, 37, 38 are more specifically defined as a front sidewall 38, a rear sidewall 36, and a pair of lateral sidewalls 35 and 37. Each tubular base leg 30 has an open slot 38*a* defined through the front sidewall 38 providing open passage into an inner chamber 39 of each base leg 30. The upper end 32 of each leg 30 is welded to a side 24*a* of a continuous outer sidewall 24, respectively, of center post 22. The center post 22 and legs 30 are constructed from 2.5 inch square steel stock. The plurality of tubular base legs 30 are shown herein as being four in number.

The lower end 34 of each leg 30 includes an apron 336 welded there around in such a manner so as to form an enlarged foot 337 about the lower end 34 of each leg 30. The enlarged feet 37 assure stability of the apparatus 10 of the present invention.

Referring now to FIGS. 1-7, and more specifically to FIGS. 4-7, a lift platform 40 is provided for engaging an underside of a chassis C of a motorcycle M. The lift platform 40 includes an upper surface 42 and a lower surface 43, and wherein the lift platform 40 includes downwardly depending forward and rearward ends 44 and 45. The lift platform 40 is constructed from steel stock having a thickness measuring approximately 0.120 inches.

A rubber pad 50 is secured to the upper surface 42 of platform 40, the rubber pad 50 directly engages the underside of the motorcycle chassis C, thereby providing an anti-skid surface upon which motorcycle chassis C engages.

A linearly elongated, tubular center member 60 is welded centrally to the lower surface 43 of platform 40 so as to extend downward vertically therefrom. The tubular center member 60 includes an open bottom 62. The center member 60 is telescopically received by the center post 22. An elongated flange 46 is welded to the lower surface 43 of the platform 40 between the forward end 44 and the center member 60 thereof.

Figure 4:
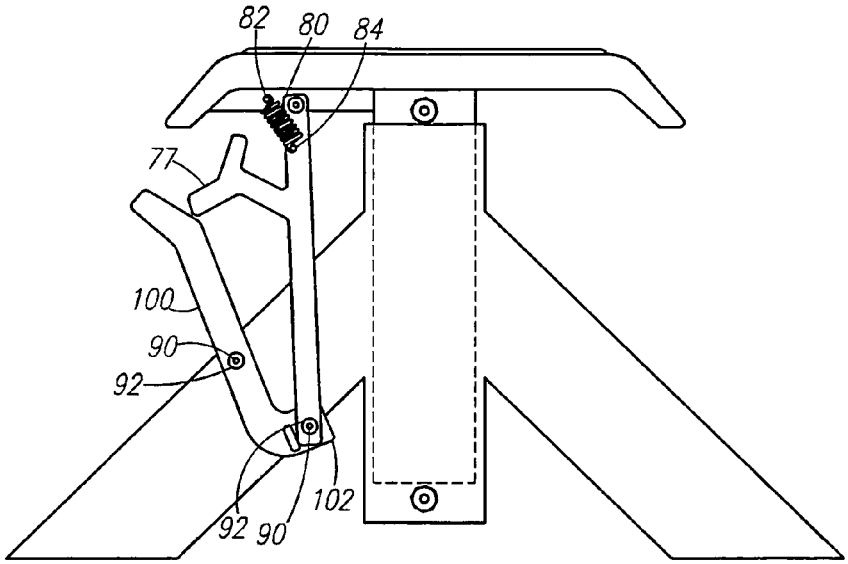
FIG. 4 is a fragmentary cross-sectional view of the platform shown in a lowered resting position, according to the preferred embodiment of the present invention.
Figure 5:
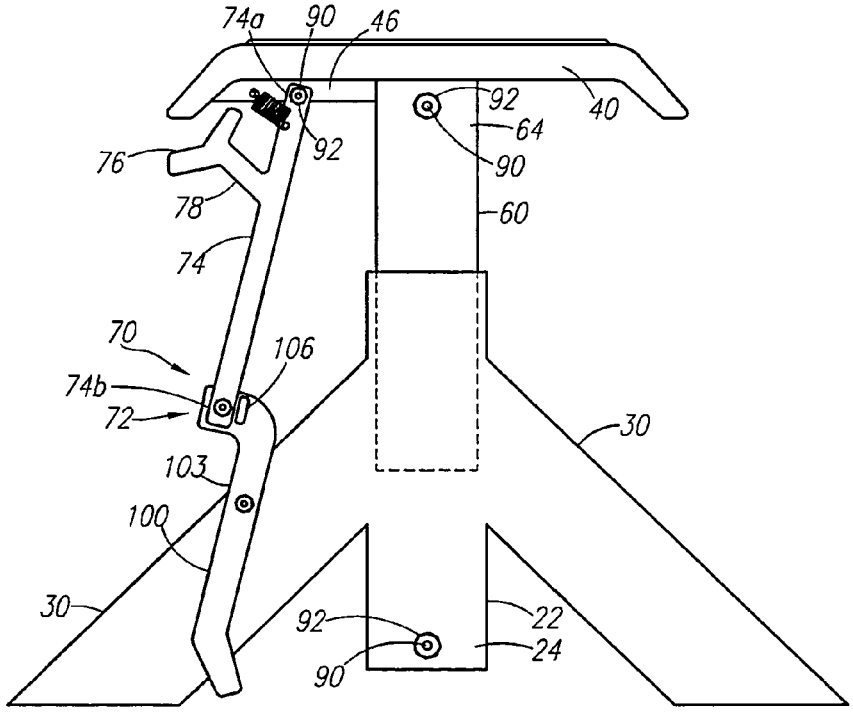
FIG. 5 is a fragmentary cross-sectional view of the platform of the present invention shown in a fully raised stabilized position, according to the preferred embodiment thereof.
Figure 6:
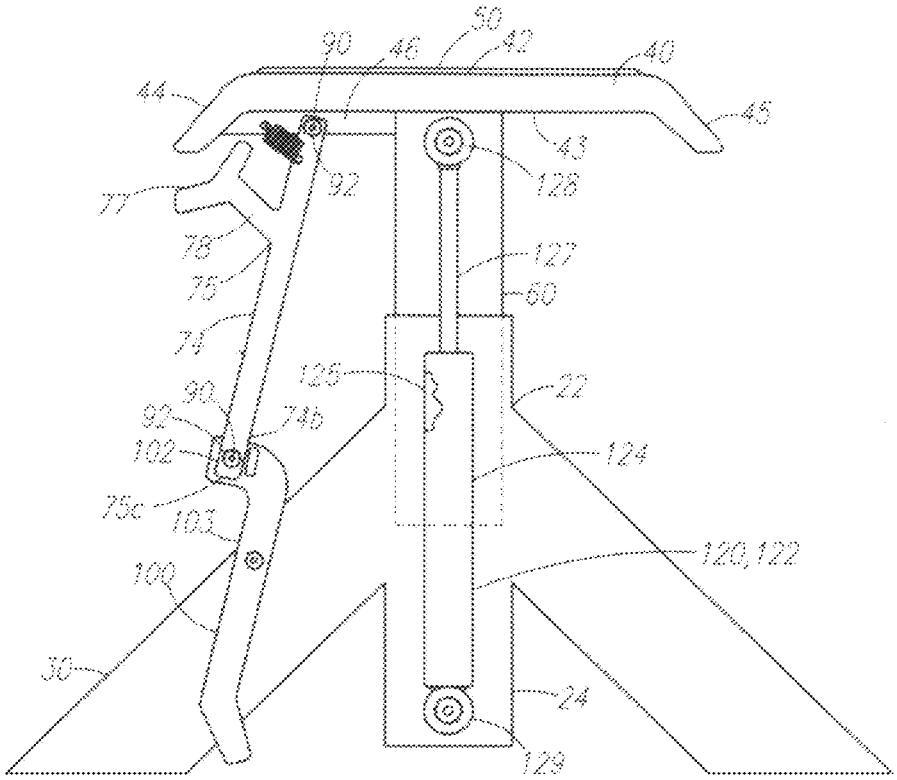
FIG. 6 is a fragmentary cross-sectional view of the platform illustrating the compression damper, wherein the platform is shown in a fully raised stabilized position, according to the preferred embodiment of the present invention.
Figure 7:
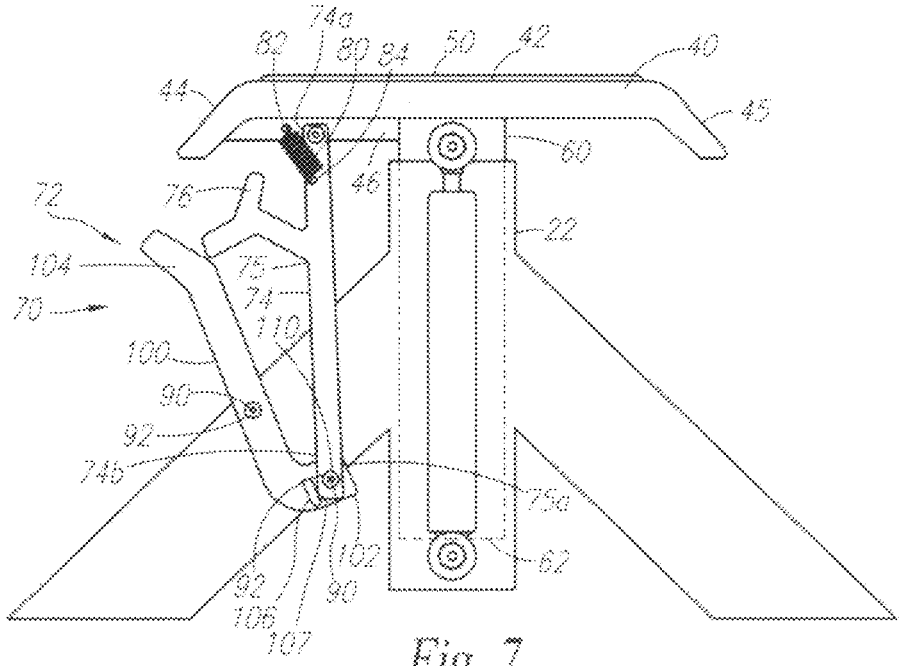
FIG. 7 is a fragmentary cross-sectional view of the platform illustrating the compression damper, wherein the platform is shown in a lowered resting position, according to the preferred embodiment of the present invention.

A platform linear actuator 70 is provided for raising the platform 40 between a lowered position (as shown in FIGS. 4 and 7) and a fully raised position (as shown in FIGS. 5 and 6). The actuator 70 comprises a linkage 72 comprised of a rigid, upper long link member 74 and a rigid, lower short link member 100. An inner sidewall of upper long link member 74, at an upper end 74*a* thereof, is pivotally coupled to the flange 46 of platform 40 as by a bolt 90 threadedly engaging a nut 92. A spring 80, having an upper end 82 coupled to the flange 46 and a lower end 84 coupled to an outer sidewall of the upper long link member 74, biases the upper long link member 74 in a relatively stationary position. The upper long link member 74 includes a pedal 76 mounted to the front wall 75 thereof, the pedal 76 extending upward angularly therefrom. The pedal 76 comprises an elongated stem 78 to which a generally syncline plate 77 is mounted, such as by welding, to an upper end thereof. A lower end of stem 78 is mounted, such as by welding, to the front wall 75 of the upper long link member 74.

The lower short link member 100 comprises a generally L-shaped configuration defining an elongated body 101 having an upper, curved end 102 and a lower, downwardly projecting tail 104. The upper, curved end 102 is pivotally coupled on the inner sidewall of the upper long link member 74 at a lower end 74*b* thereof as by a bolt 90 threadedly engaging a nut 92, thereby forming a pivot point 110. The lower short link member 100 is further pivotally coupled on an outer sidewall of one of the plurality of tubular base legs 30 at a position proximally mesial of the upper, curved end 102 and tail 104 of the lower short link member 100 as by a bolt 90 threadedly engaging a nut 92.

The lower short link member 100 includes a stop 106 mounted, such as by welding, perpendicularly to an outer sidewall of the upper, curved outer end 102 thereof. The stop 106 is positioned parallel to a front wall 103 of lower short link member 100 and juxtaposed to the lower end 74*b* of the upper long link member 74. The stop 106 includes a link member engagement surface 107.

A compression damper 120 is provided in the form of a shock absorber 122 for lowering the platform 40 in a controlled manner. The shock absorber 122 is housed within the center member 60 and extends outward through the open bottom end 62 thereof. The shock absorber 122 comprises a protective housing 124 having an internal working chamber 125 within which an elongated piston rod 127 vertically reciprocates. The piston rod 127 includes an upper mount 128 and a lower mount 129. The upper mount 128 is mounted to a sidewall 64 of center member 60 as by a bolt 90 threadedly engaging a nut 92. The lower mount 129 is mounted to an outer sidewall 24 of center post 22 as by a bolt 90 threadedly engaging a nut 92.

Figure 1A:
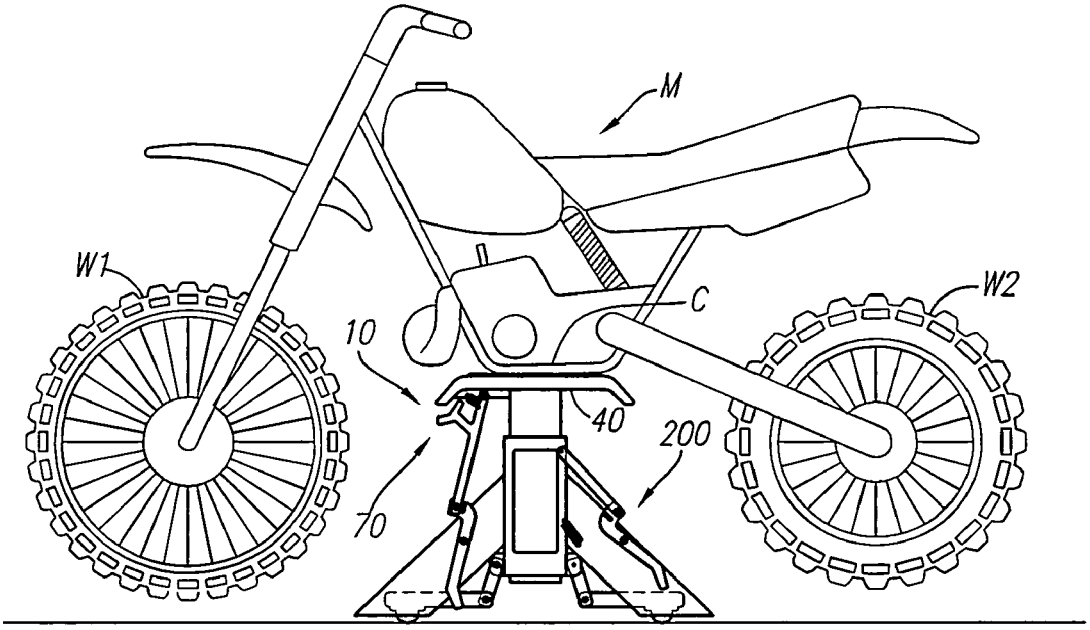
FIG. 1A is a side elevational view of the preferred embodiment of FIG. 1 shown in-use.

As shown in FIG. 1A, the rubber pad 50 secured to the upper surface 42 of platform 40 engages the underside of the motorcycle chassis C, and the motorcycle M is raised via the platform linear actuator 70, whereby the motorcycle wheels W1 and W2 are free and clear of any other means of support.

In order to raise the platform 40 from a lowered resting position to a fully raised position, the lower, downwardly projecting tail 104 of the lower short link member 100 is urged downward, either by a hand or foot, thereby causing the lower short link member 100 to rotate pivotally about the pivot point 110 and the link member engagement surface 107 of stop 106 engages a bottom end 75*c* of the upper long link member 74 which urges the upper long link member 74 upward, and in turn raises platform 40. The lower short link member 100 is urged further downward so as to be aligned parallel with respect to the upper long link member 74, and such that the link member engagement surface 107 of stop 106 engages the rear wall 75*a* of the upper long link member 74, thereby stabilizing the platform 40 in the fully raised position.

In order to lower the platform 40 from a raised stabilized position to a lowered resting position, the syncline plate 77 of the pedal 76 is urged downward, either by a hand or foot, which releases engagement by the link member engagement surface 107 of the stop 106 with the rear wall 75*a* of the upper long link member 74, and simultaneously the lower short link member 100 rotates pivotally in a reverse direction and in a controlled manner about the pivot point 110 until platform 40 rests in a lowered position.

Referring now to FIGS. 1, and 8-13, a caster carriage assembly 130 is disclosed, wherein the caster carriage assembly 130 comprises a first framework 132 and a second framework 140. The first framework 132 comprises opposed side rails 133, 135 having ends securably mounted, such as by arc welding, to ends of opposed end rails 137, 139. The first framework 132 is positioned around and snugly engages an upper portion of the center post 22, above the legs 30.

The second framework 140 comprises opposed side rails 142, 144 having ends securably mounted, such as by arc welding, to ends of opposed end rails 146, 148. The second framework 140 is positioned around and snugly engages a lower portion of the center post 22, below an attachment by each of the legs 30 to the center post 22. The opposed side rails 142, 144 include a flange 170 mounted centrally, such as by welding, to an outer surface of the opposed side rails 142, 144. The end rails 146, 148 include a flange 172 mounted centrally, such as by welding, to an outer surface of the end rails 146, 148.

Figure 8:
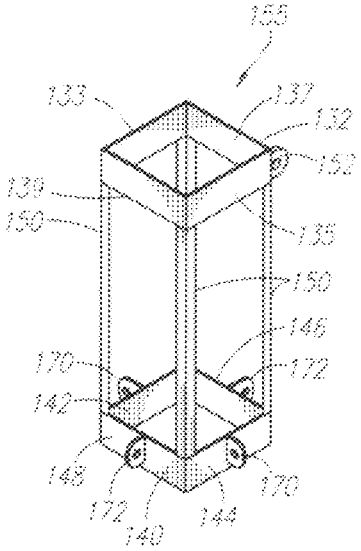
FIG. 8 is a perspective view of the open sided box structure of the caster carriage assembly according to the preferred embodiment of the present invention.
Figure 9:
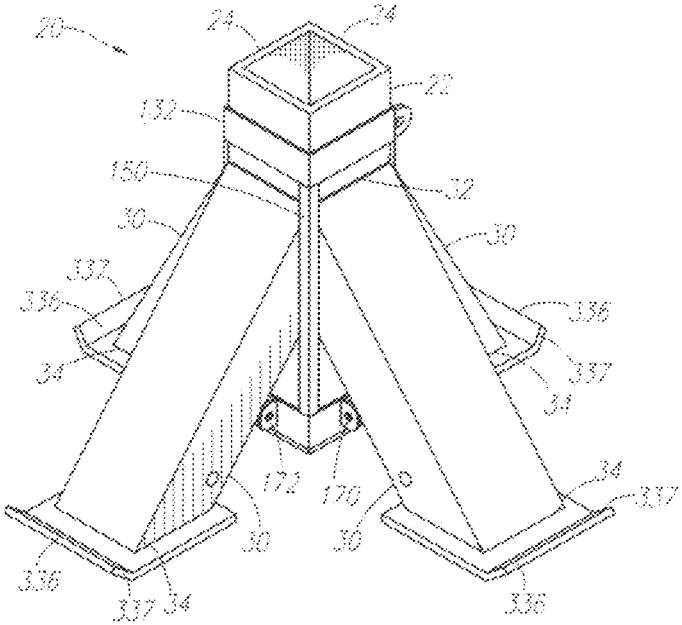
FIG. 9 is a perspective view of the open sided box structure engaged around the center post of the present invention, according to the preferred embodiment thereof.
Figure 10:
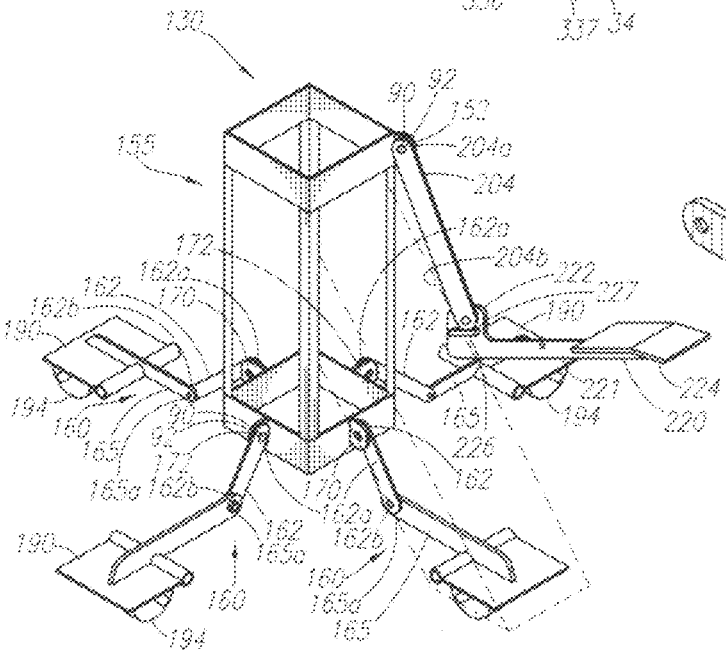
FIG. 10 is a perspective view of the caster carriage assembly, according to the preferred embodiment of the present invention.
Figure 11:
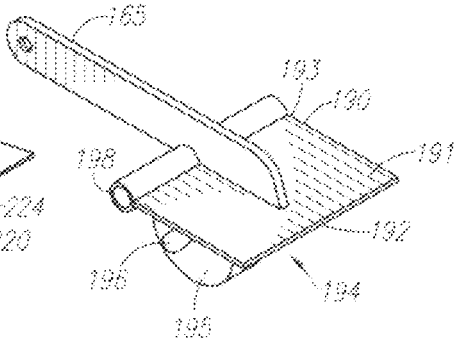
FIG. 11 is a perspective view of a caster assembly, according to the preferred embodiment of the present invention.

The first framework 132 is permanently connected to the second framework 140 by a plurality of vertical rails 150 so as to form a box structure 155 with open sides, as more clearly shown in FIG. 8. A linkage connection flange 152 is mounted to an upper end of a vertical rail 150, the vertical rail 150 is connected between an upper opposed side rail 135 of the first framework 132 and a lower opposed side rail 144 of the second framework 140.

The caster carriage assembly 130 further comprises a plurality of caster linkage assemblies 160, wherein each caster linkage assembly 160 comprises a rigid, short link member 162 and a rigid, long link member 165. The plurality of caster linkage assemblies 160 are each arranged so as to be partially housed within a respective inner chamber 39 of each respective leg 30. An inner sidewall of each short link member 162, at an upper end 162*a* thereof, is fixedly mounted to a flange 170, 172 of the opposed side rails 142, 144 and end rails 146, 148, respectively, as by a bolt 90 threadedly engaging a nut 92. An inner sidewall of each long link member 165, at a lower end 165*a* thereof, is pivotally coupled on an outer sidewall of a respective short link member 162 at a lower end 162*b* thereof as by a bolt 90 threadedly engaging a nut 92, thereby forming a pivot point 180. The lower end 165*a* of each long link member 165 includes a caster assembly support plate 190 mounted, such as by welding, to a lower surface thereof. The caster assembly support plate 190 has a top surface 191 opposing a bottom surface 192. A lower end 193 of each caster assembly support plate 190 includes a pin receiving sleeve 198 mounted, such as by welding, thereto. The caster assembly support plate 190 is pivotally mounted to a respective tubular base leg 30, proximal the lower end 34 thereof, via a pin 199 which extends through the pin receiving sleeve 198 and through holes 199*a* defined in opposing lateral sidewalls 35 and 37 of each tubular base leg 30.

A caster assembly 194 is secured to and extends downwardly from the bottom surface 192 of the caster assembly support plate 190. Each caster assembly 194 can be any suitable commercially available product that typically includes a rubber wheel 195 that rotates about vertical (swivel motion) and horizontal (rolling motion) axes. Each caster assembly 194 may be provided with a foot operated brake lever 196 for controlling the rolling motion.

Figure 12:
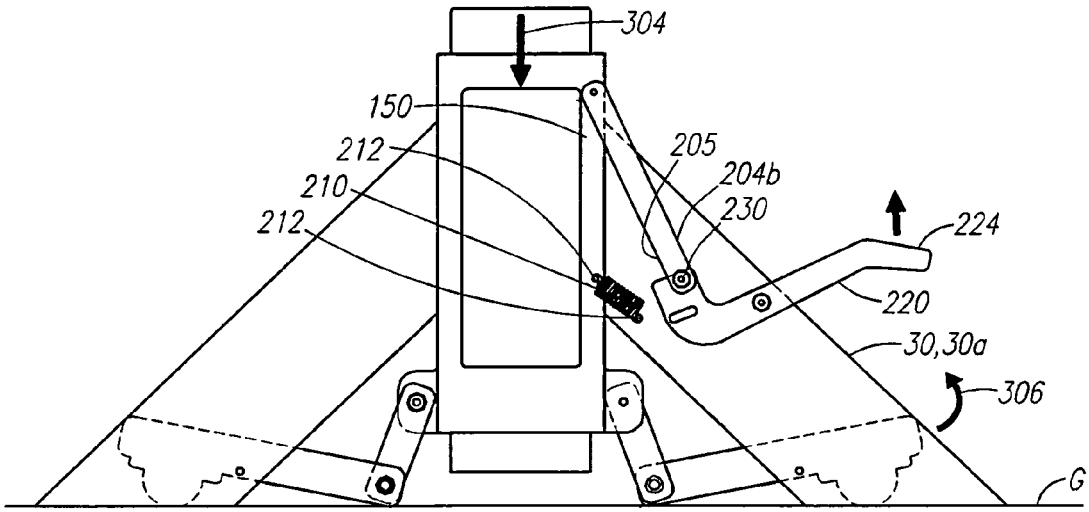
FIG. 12 is a partial fragmentary, cross-sectional side elevational view of the caster assemblies shown in a pivotally raised position residing within the inner chamber of a respective base leg, according to the preferred embodiment of the present invention.
Figure 13:
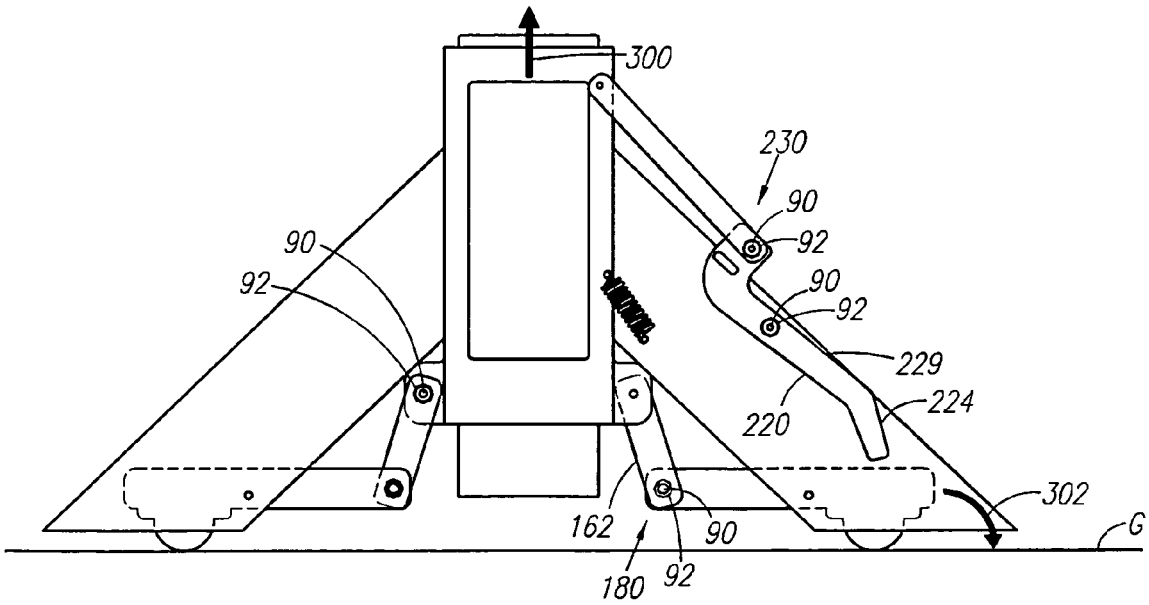
FIG. 13 is a partial fragmentary, cross-sectional side elevational view of the of the caster assemblies shown in a pivotally lowered position in contact with the ground surface, according to the preferred embodiment of the present invention.

Referring now more specifically to FIGS. 1, and 10-13, a carriage linear actuator 200 is provided for raising the caster carriage assembly 130 between a lowered position (as shown in FIG. 12) and a fully raised position (as shown in FIG. 13). Raising the caster carriage assembly 130 actuates simultaneous lowering of all the caster assemblies 194, and lowering the caster carriage assembly 130 actuates simultaneous raising of all the caster assemblies 194. The actuator 200 comprises a linkage 202 comprised of a rigid, upper long link member 204 and a rigid, lower short link member 220. An outer sidewall of the upper long link member 204, at an upper end 204*a* thereof, is pivotally coupled to the linkage connection flange 152 of caster carriage assembly 130 as by a bolt 90 threadedly engaging a nut 92. A spring 210, having an upper end 212 coupled to the vertical rail 150 with attached linkage connection flange 152, and a lower end 212 coupled to a proximal leg 30*a* of the plurality of tubular base legs 30, biases the caster carriage assembly 130 in a relatively stationary position.

The rigid, lower short link member 220 comprises a generally L-shaped configuration defining an elongated body 221 having an upper, curved end 222 and a lower, downwardly projecting tail 224. The upper, curved end 222 is pivotally coupled on an outer sidewall of the upper long link member 204 at a lower end 204*b* thereof as by a bolt 90 threadedly engaging a nut 92, thereby forming a pivot point 230. The lower short link member 220 is further pivotally coupled on an outer sidewall of the proximal leg 30*a* of the plurality of tubular base legs 30 at a position proximally mesial to the upper, curved end 222 and tail 224 of the lower short link member 220 as by a bolt 90 threadedly engaging a nut 92.

The lower short link member 220 includes a stop 226 mounted, such as by welding, perpendicularly to an inner sidewall of the upper, curved end 222 thereof. The stop 226 is positioned parallel to a front wall 229 of lower short link member 220 and juxtaposed to the lower end 204*b* of the upper long link member 204. The stop 226 includes a link member engagement surface 227.

In order to lower the caster assemblies 194 to permit rolling mobility of the apparatus 10, the lower, downwardly projecting tail 224 of the lower short link member 220 is urged downward, either by a hand or foot, thereby causing the lower short link member 220 to rotate pivotally clockwise about the pivot point 230 and the link member engagement surface 227 of stop 226 engages the lower end 204*b* of the upper long link member 204 which urges the upper long link member 204 upward, and in turn simultaneously raises the box structure 155 (as indicated by direction arrow 300) of caster carriage assembly 130 and facilitating lowered pivoting of the caster assemblies 194. The lower short link member 220 is urged further downward so as to be aligned parallel with respect to the upper long link member 204, and such that the link member, engagement surface 227 of stop 226 engages a rear wall 205 of the upper long link member 204, thereby stabilizing the box structure 155 in a fully raised position and pivotal lowering of the caster assemblies 194 about pin 199 (as indicated by direction arrow 302) in contact with a ground surface G.

In order to raise the caster assemblies 194, thereby immobilizing the apparatus 10, the lower, downwardly projecting tail 224 of the lower short link member 220 is urged upward pivotally, either by a hand or foot, which releases engagement by the link member engagement surface 227 of the stop 226 with the rear wall 205 of the upper long link member 204, and wherein the lower short link member 220 rotates pivotally counter-clockwise and in a controlled manner about the pivot point 230 which simultaneously facilitates lowering of the box structure 155 (as indicated by direction arrow 304) of caster carriage assembly 130 and pivotal raising of the caster assemblies 194 about pin 199 (as indicated by direction arrow 306) until the plurality of tubular base legs 30 rests in a lowered stabilized position atop the ground surface G.

The use of the present invention allows a motorcycle M to be supported in a raised position and mobilized while in such raised position according to user preference in a quick, easy, and efficient manner.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A motorcycle lift and support apparatus, the apparatus comprising:

a base frame, the base frame comprising:

a vertically extending, tubular center post, the center post has a plurality of sides forming a continuous outer sidewall;

a plurality of tubular base legs extend downward angularly from the center post;

a lift platform for engaging an underside of a chassis of a motorcycle, the lift platform comprising an upper surface and a lower surface, the lift platform includes a downwardly depending forward end and a downwardly depending rearward end;

a linearly elongated, tubular center member welded centrally to the lower surface of the lift platform so as to extend downward vertically therefrom, the center member includes an open bottom, and wherein the center member is telescopically received by the center post;

an elongated flange welded to the lower surface of the lift platform between the downwardly depending forward end and the center member;

a platform linear actuator pivotally coupled to the flange for raising the lift platform between a lowered position and a fully raised position;

a caster carriage assembly engaging the center post; and a carriage linear actuator for raising the caster carriage assembly between a lowered position and a fully raised position.

2. The apparatus of claim 1, wherein the plurality of tubular base legs each define an upper end opposing a lower end and four sidewalls, each of the plurality of tubular base legs has an open slot defined through a front sidewall of the four sidewalls, the open slot providing open passage into an inner chamber of each of the plurality of tubular base legs, and wherein the upper end of each of the plurality of tubular base legs is welded to a respective side of the continuous outer sidewall of the center post.

3. The apparatus of claim 2, wherein the lower end of each of the plurality of tubular legs includes an apron welded there around in such a manner so as to form an enlarged foot, thereby assuring stability of the apparatus.

4. The apparatus of claim 1, further comprising a rubber pad, the rubber pad is secured to the upper surface of the lift platform, the rubber pad for directly engaging an underside of a motorcycle chassis, thereby providing an anti-skid surface upon which the motorcycle chassis is configured to engage.

5. The apparatus of claim 1, wherein the platform linear actuator comprises a linkage, the linkage comprises:

a rigid, upper long link member;

a rigid, lower short link member pivotally coupled to the rigid, upper long link member; and a spring for biasing the upper long link member in a relatively stationary position.

6. The apparatus of claim 5, wherein the upper long link member is pivotally coupled to the flange of the lift platform along an inner sidewall of the upper long link member, about an upper end thereof, and wherein the spring has an upper end coupled to the flange and a lower end coupled to an outer sidewall of the upper long link member.

7. The apparatus of claim 6, wherein the upper long link member includes a pedal mounted to a front wall of the upper long link member, the pedal extending upward angularly therefrom.

8. The apparatus of claim 7, wherein the pedal comprises an elongated stem to which a generally syncline plate is mounted to an upper end of the stem, the stem includes a lower end mounted to the front wall of the upper long link member.

9. The apparatus of claim 5, wherein the lower short link member comprises a generally L-shaped configuration defining an elongated body having an upper, curved end and a lower, downwardly projecting tail, wherein the upper, curved end is pivotally coupled on an inner sidewall of the upper long link member at a lower end of the upper long link member, thereby forming a pivot point, and wherein the lower short link member is further pivotally coupled on an outer sidewall of one of the plurality of tubular base legs at a position proximally mesial of the upper, curved end and the tail of the lower short link member.

10. The apparatus of claim 9, wherein the lower short link member includes a stop mounted perpendicularly to an outer sidewall of the upper, curved outer end of the lower short link member, the stop is positioned parallel to a front wall of the lower short link member and juxtaposed to the lower end of the upper long link member.

11. The apparatus of claim 1, wherein the center member has a compression damper housed therein, the compression damper is in the form of a shock absorber for lowering the lift platform in a controlled manner.

12. The apparatus of claim 11, wherein the shock absorber extends outward through the open bottom of the center member, the shock absorber comprises a protective housing having an internal working chamber within which an elongated piston rod vertically reciprocates, the piston rod includes an upper mount and a lower mount, the upper mount is mounted to a sidewall of the center member, the lower mount is mounted to an outer sidewall of the center post.

13. The apparatus of claim 1, wherein the caster carriage assembly comprises a first framework and a second framework, the first framework comprises opposed side rails having ends securably mounted to ends of opposed end rails, the first framework is positioned around and snugly engages an upper portion of the center post, above the plurality of tubular base legs, the second framework comprises opposed side rails having ends securably mounted to ends of opposed end rails, the second framework is positioned around and snugly engages a lower portion of the center post, below an attachment by each of the plurality of tubular base legs to the center post, the opposed side rails of the second framework include a flange mounted centrally to an outer surface of the opposed side rails of the second framework, and wherein the opposed end rails of the second framework include a flange mounted centrally to an outer surface of the opposed end rails of the second framework.

14. The apparatus of claim 13, wherein the first framework is permanently connected to the second framework by a plurality of vertical rails so as to form a box structure with open sides, and wherein one vertical rail of the plurality of vertical rails has a linkage connection flange mounted to an upper end thereof, the one vertical rail is connected between an upper opposed side rail of the first framework and a lower opposed side rail of the second framework.

15. The apparatus of claim 13, wherein the caster carriage assembly further comprises a plurality of caster linkage assemblies, wherein each caster linkage assembly comprises a rigid, short link member and a rigid, long link member, the plurality of caster linkage assemblies are each arranged so as to be partially housed within a respective inner chamber of each respective leg of the plurality of tubular base legs, wherein each the short link member, at an upper end and inner sidewall thereof, is fixedly mounted to a flange of the opposed side rails and opposed end rails, respectively, and wherein each the long link member, at a lower end and inner sidewall thereof, is pivotally coupled on an outer sidewall of a respective short link member at a lower end of the respective short link member, thereby forming a pivot point, the lower end of each the long link member includes a caster assembly support plate mounted to a lower surface of each the long link member, the caster assembly support plate has a top surface opposing a bottom surface, and wherein the caster assembly support plate includes a caster assembly secured to and extending downwardly from the bottom surface of the caster assembly support plate, the caster assembly includes a wheel that rotates about a vertical and a horizontal axes.

16. The apparatus of claim 1, wherein the carriage linear actuator allows for the manual raising of the caster carriage assembly between a lowered position and a fully raised position, whereby raising the caster carriage assembly actuates simultaneous lowering of all the caster assemblies, and lowering the caster carriage assembly actuates simultaneous raising of all the caster assemblies, wherein the carriage linear actuator comprises:

a linkage comprised of a rigid, upper long link member and a rigid, lower short link member, the upper long link member has an outer sidewall at an upper end thereof pivotally coupled to a linkage connection flange of the caster carriage assembly; and a spring having an upper end coupled to a vertical rail having a linkage connection flange mounted thereto, the spring having a lower end coupled to a proximal leg of the plurality of tubular base legs, the spring biases the caster carriage assembly in a relatively stationary position.

17. The apparatus of claim 16, wherein the rigid, lower short link member comprises a generally L-shaped configuration defining an elongated body, the elongated body having an upper, curved end and a lower, downwardly projecting tail, the upper, curved end is pivotally coupled on an outer sidewall of the upper long link member at a lower end thereof, thereby forming a pivot point, the lower short link member is further pivotally coupled on an outer sidewall of the proximal leg of the plurality of tubular base legs at a position proximally mesial to the upper, curved end and the tail of the lower short link member the lower short link member includes a stop mounted perpendicularly to an inner sidewall of the upper, curved end thereof, the stop is positioned parallel to a front wall of the lower short link member and juxtaposed to a lower end of the upper long link member.

18. The apparatus of claim 10, wherein the lower, downwardly projecting tail of the lower short link member of the platform linear actuator is urged downward, thereby causing the lower short link member to rotate pivotally about the pivot point and the stop engages a bottom end of the upper long link member which urges the upper long link member upward, and in turn raises the lift platform, whereupon the lower short link member is urged further downward so as to be aligned parallel with respect to the upper long link member, and such that the stop engages a rear wall of the upper long link member, thereby stabilizing the lift platform in a fully raised position, whereupon in order to lower the lift platform from a raised stabilized position to a lowered resting position, a syncline plate of a pedal of the upper long link member is urged downward which releases engagement by the stop with the rear wall of the upper long link member, and simultaneously the lower short link member rotates pivotally in a reverse direction and in a controlled manner about the pivot point until the lift platform rests in a lowered position.

19. The apparatus of claim 17, wherein the lower, downwardly projecting tail of the lower short link member of the carriage linear actuator is urged downward, thereby causing the lower short link member to rotate pivotally clockwise about the pivot point and the stop engages a lower end of the upper long link member which urges the upper long link member upward, and in turn simultaneously raises a box structure of the caster carriage assembly and facilitating lowered pivoting of a caster assemblies, the lower short link member is urged further downward so as to be aligned parallel with respect to the upper long link member, and such that the stop engages a rear wall of the upper long link member, thereby stabilizing the box structure in a fully raised position and pivotal lowering of the caster assemblies in contact with a ground surface, thereby permitting rolling mobility of the apparatus.

20. The apparatus of claim 17, wherein the lower, downwardly projecting tail of the lower short link member is urged upward pivotally, which releases engagement by the stop with the rear wall of the upper long link member, and wherein the lower short link member rotates pivotally counter-clockwise and in a controlled manner about the pivot point which simultaneously facilitates lowering of the box structure of the caster carriage assembly and pivotal raising of the caster assemblies until the plurality of the tubular base legs rests in a lowered stabilized position atop the ground surface, thereby immobilizing the apparatus.

* * * * *